US005491993A

United States Patent [19]

Anderson

[11] Patent Number: 5,491,993

[45] Date of Patent: Feb. 20, 1996

[54] USER-INSTALLED FURNITURE LOCK

[75] Inventor: Victor R. Anderson, Trumbull, Conn.

[73] Assignee: Loctec Corporation, Newtown, Conn.

[21] Appl. No.: 210,050

[22] Filed: Mar. 17, 1994

[51] Int. Cl.[6] ..... E05B 27/00; E05B 65/46

[52] U.S. Cl. ..... 70/367; 70/369; 70/85

[58] Field of Search ..... 70/18, 367, 368, 70/369, 379, 449, 494, 127

[56] References Cited

U.S. PATENT DOCUMENTS

| | | | |
|---|---|---|---|
| 2,255,402 | 9/1941 | Vile | 70/367 |
| 3,055,691 | 9/1962 | Kessel | 70/449 |
| 3,789,638 | 2/1974 | Roberts et al. | 70/368 |
| 3,992,907 | 11/1976 | Pilvet | 70/379 |
| 4,208,894 | 6/1980 | Surko, Jr. | 70/494 |
| 4,667,491 | 5/1987 | Lokken et al. | 70/18 |
| 5,152,161 | 10/1992 | Lee | 70/127 |
| 5,168,734 | 12/1992 | Duval et al. | 70/369 |

*Primary Examiner*—Steven N. Meyers
*Assistant Examiner*—Tuyet-Phuong Pham
*Attorney, Agent, or Firm*—Haynes N. Johnson

[57] ABSTRACT

A lock having a housing and flange, a lock cylinder, a cam lever, and a lock nut. The housing has a length which is slightly less than the thickness of the panel into which it is to be inserted. Its exterior surface has axial ridges which engage with the inner surface of the panel hole in which the housing is inserted. The ridges preferably extend only a short distance from the flange. These ridges hold the housing in place and prevent it from turning in the panel hole. The lock cylinder, which fits within the housing, has a threaded portion extending outwardly to receive the cam lever and the lock nut. Tightening up on the lock nut serves to draw the housing fully into the hole and to clamp the housing in place. The lock cylinder is keyed to the inner surface of the housing; and the cam lever is keyed to the threaded portion.

11 Claims, 3 Drawing Sheets

USER-INSTALLED FURNITURE LOCK

FIELD OF THE INVENTION

This invention relates to cam locks for furniture, and, in particular, locks for use with knock-down furniture which is assembled by the purchaser. Such locks must be easy to install, without risk of damage to the furniture.

BACKGROUND OF THE INVENTION

Cam locks are often included in the sale of consumer-assembled furniture, such as desks or filing cabinets. They have been made to be inserted into a round hole in one of the panels, and to be held in place by use of a spur washer (to prevent turning) and a nut. To accommodate this structure, the locks have a long housing, threaded on the outside, a lock cylinder to fit within the housing, and a cam lever mounted at the end of the cylinder. This number of elements adds unnecessary cost to the lock assembly. In addition, the locks often have to be hammered into position, which can sometimes result in damage to the panel.

I have invented a simpler lock with fewer parts, which is easier to install, and which has a lower manufacturing cost.

BRIEF SUMMARY OF THE INVENTION

My lock is formed of a housing with a front flange, a lock cylinder, a cam lever, ad a nylon insert lock nut. The housing has a length, measured from its flange, which is slightly less than the thickness of the panel into which it is to be inserted. Its exterior surface has ridges, parallel to the axis of the housing, which engage with the inner surface of the panel hole in which the housing is inserted. The ridges preferably extend only a short distance from the flange, allowing the user to insert most of the housing into the hole by hand. These ridges hold the housing in place and prevent it from turning in the hole. The lock cylinder, which fits within the housing, has a a short threaded portion to receive the cam lever and the lock nut. Tightening up on the lock nut serves to clamp the cam lever against the inner surface of the panel and so draw the housing fully into the hole. The lock cylinder is keyed to the inner surface of the housing; and the cam lever is keyed to the threaded portion.

Thus, the user, when assembling the furniture, simply inserts the cylinder and housing into a pre-cut hole in the panel, places the cam lever over the end, and tightens up on the nut to complete the installation. It is a system which is not likely to result in user error.

In a modification of my invention, the cam lever is screw-mounted on the outer end of the threaded portion, and a washer nut is positioned on the threaded portion inside the lever. Installation is completed by tightening the washer-nut. The lever arm, which can include an offset arm, can be positioned with the arm near to or away from the inner panel surface.

DETAILED DESCRIPTION OF THE INVENTION

Figure 1:
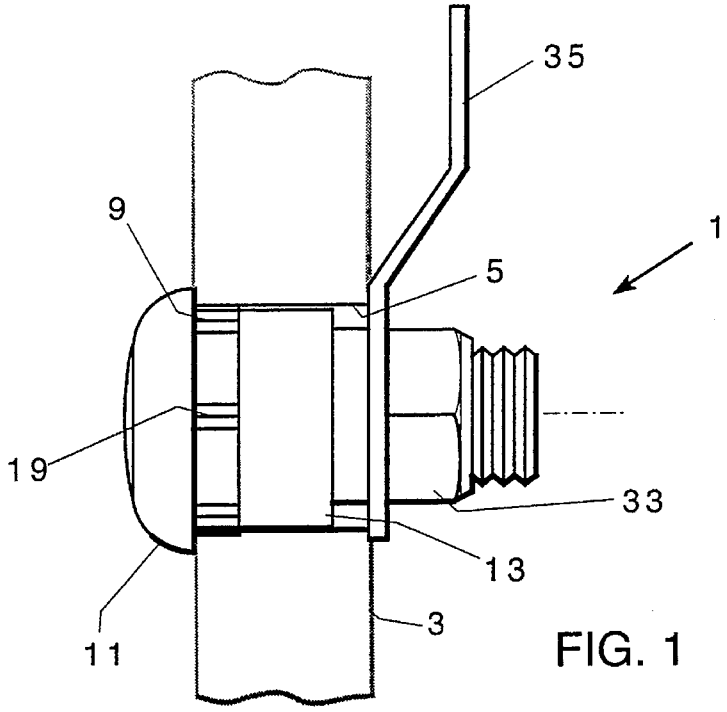
FIG. 1 is a side elevation of the lock of my invention. The panel in which it is installed is shown in phantom.
Figure 2:
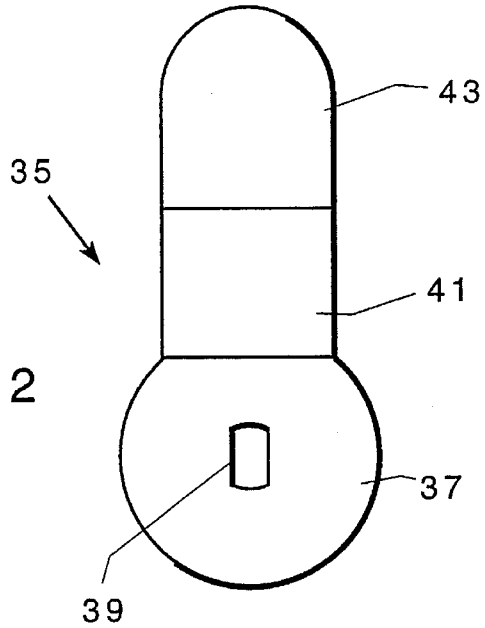
FIG. 2 is an elevation of the cam lever of FIG. 1.
Figure 3:
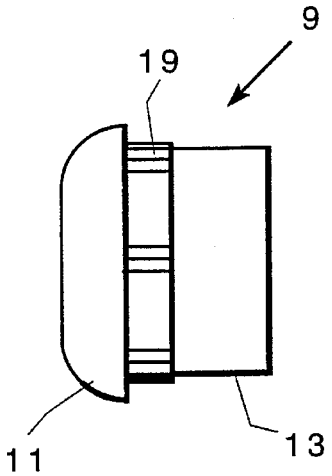
FIG. 3 is a side elevation of the housing for my lock.
Figure 4:
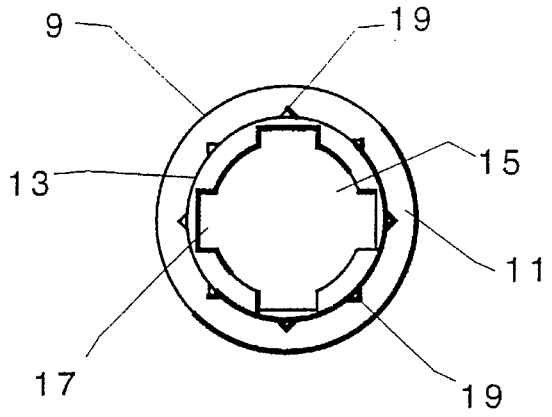
FIG. 4 is a rear elevation of the housing.
Figure 5:
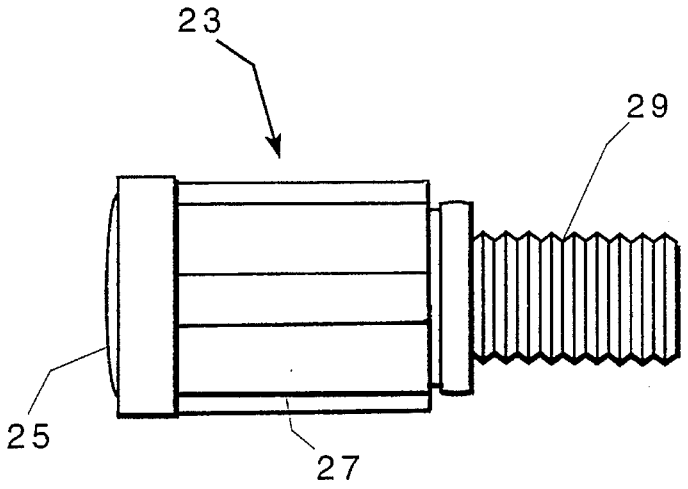
FIG. 5 is a side elevation of the cylinder plug.
Figure 6:
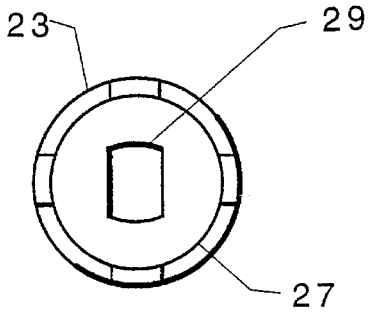
FIG. 6 is a rear elevation of the cylinder plug.

In FIG. 1 my lock 1 is shown mounted in furniture panel 3 (in phantom). The panel has parallel outer and inner surfaces and a circular lock hole 5 with its axis transverse to the surfaces. Lock housing 9 fits within hole 5 in the panel. The housing includes front flange 11, cylindrical body 13, and opening 15 (FIG. 4) with key slots 17 to receive a lock cylinder 23.

Housing 9 has an outer diameter approximating the inner diameter of the hole 5, and a length from the inner surface of its front flange 11 (which abuts the outer surface) slightly less than the length of the hole. As shown below, this permits the cam lever 35 to clamp against the inner surface and so hold the housing in place.

Body 13 includes a series of circumferentially spaced ridges 19. These ridges 19 run in a direction parallel to the axis of the body, i.e., parallel to the axis of the hole. They preferably run for a distance of about a third of the length of the body, and begin adjacent to the inner surface of the front flange 11. They can, however, if desired, run for the full length of the body. These ridges 19 are dimensioned to engage with the inner surface of hole 5; and they serve to prevent rotation of the body with respect to the hole, i.e., with respect to the panel, keeping the body steady when a key is turned in the lock cylinder.

Lock cylinder 23 fits within the body 13 of housing 9, and is held against rotation relative to the body by a series of keys 28 and key slots 17 on plug 23 and body 13. Lock cylinder 23 includes a key slot area 25, a cylinder body 27, and a threaded member 29, of lesser diameter than the body 27, extending outwardly from the cylinder body 27. The threaded member 29 has a double-D cross section to receive a complementary double-D opening 39 in a cam lever 35.

The cam lever 35 includes a mounting portion 37, with the double-D opening 39, an angled section 41, and a locking end 43.

To install the lock, the body 13 of the housing 9, carrying the lock cylinder 23, is inserted into the hole 5 in panel 3. The portion of the body carrying axial ridges 19 will not easily go into the hole, only that portion without the ridges. The cam lever 35 is fitted over the threaded member 29, and a nylon insert lock nut 33 put on the threaded member. By tightening up the lock nut, the body 13 will be drawn into the hole until front flange 11 abuts the inner surface of panel 3 and clamps the lock cylinder in place. Since this puts pressure on the cam lever, the nut should then be backed off slightly (about half a turn). Body 13 is then secure within hole 5, and ridges 19 engage with the inner surface of the hole, preventing rotation of the housing with respect to the hole.

The above-described structure has several advantages over the prior art locks. The housing is fitted into the hole without having to be hammered in, thus avoiding possible damage to the panel. The axial ridges prevent twisting of the housing in the hole, avoiding the need for a spur washer to secure the housing. Since no spur washer is required, the threaded portion of the cylinder plug can be of smaller diameter and can be shorter, saving material costs. This also means that a large hex mounting nut is not required; and a separate screw is not needed for securing the cam lever to the threaded member. I find that this structure is cost effective in that it can be made for about 20–30% less than cam locks presently in use. It is also "user-friendly" in that it is easier for the user to install.

Figure 7:
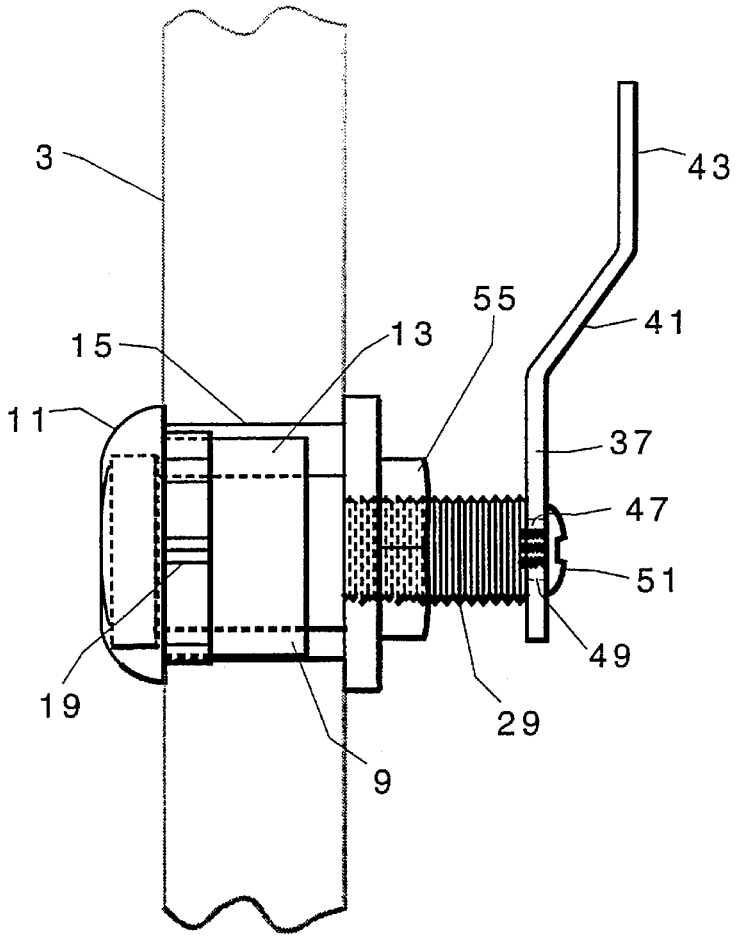
FIG. 7 is a side elevation of a modified lock. The panel in which it is installed is shown in phantom.
Figure 8:
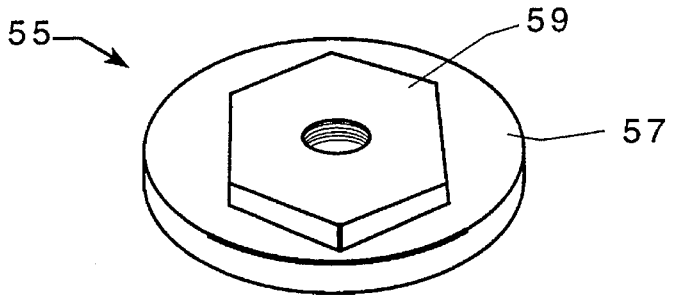
FIG. 8 is a perspective view of the washer-nut used with the modified lock.

A modification of my lock is seen in FIGS. 7 and 8. The basic structure of this modified lock is similar to that of the above-described lock, and the elements have been given similar numbers. The difference here is that the cam lever is secured by screen 51 to the outer end of threaded member 29 (which must be longer). The threaded member 29 has a key 47 at its end which fits with key slot 49 in the cam lever. Since the cam lever is at the outer end, it is necessary to use a washer-nut 55, with washer portion 57 and nut portion 59, to draw body 13 into place and secure it in position.

I claim:

1. In a lock installed in a panel, said panel having parallel inner and outer panel surfaces, a thickness, and a transverse hole through said panel to receive said lock, that improvement including a lock housing having a flange at one end thereof, said housing having a cylindrical housing body with a length less than said panel thickness and a diameter approximately the same as that of said hole, said housing body, when mounted in said hole, having an axis transverse to said panel surfaces, a lock cylinder having a common axis with said housing body and mounted within said housing body, said lock cylinder having a threaded member extending therefrom, said threaded member having a diameter less than that of said lock cylinder, a cam lever fitting about said threaded member, and means for securing said cam lever in place on said threaded member in a position in which said cam lever will press against said inner surface of said panel in all positions of said cam lever, whereby said cam lever, by pressing against said inner surface, clamps said lock cylinder in place in said hole.

2. In a lock as set forth in claim 1, the improvement in which said cam lever securing means is a nylon insert lock nut on said threaded member.

3. In a lock as set forth in claim 1, the improvement of including ridges on the outer surface of said housing body, said ridges being parallel to said axis of said housing body and being dimensioned to press against the sides of said hole to prevent rotation of said housing body relative to said hole.

4. In a lock as set forth in claim 3, the improvement in which one end of said ridges is adjacent to said flange, and said ridges are shorter than said housing body.

5. In a lock as set forth in claim 1, the improvement in which said cam lever is keyed to said threaded member to prevent relative rotation therebetween.

6. A lock and panel system for installation of the lock by the end user, said system including a panel having parallel inner and outer panel surfaces, a thickness, and a transverse hole through said panel, a lock housing having a longitudinal axis, a flange at one end thereof, and a housing body with a length less than said panel thickness, said housing body being mounted in said hole with its axis transverse to said panel surfaces and said flange abutting said outer surface, a lock cylinder having a common axis with said housing body and mounted within said housing body, said lock cylinder having a threaded member extending therefrom, said threaded member having a diameter less than that of said lock cylinder and extending beyond said inner surface, a cam lever positioned on said threaded member, and securing means for securing said cam lever in place on said threaded member, and means associated with said threaded member and said securing means for pressing said cam lever against said inner surface in all positions of said cam and thereby clamping said lock cylinder in place in said hole.

7. A lock and panel system as set forth in claim 6 in which said cam lever is secured in place against said inner surface and thereby serves to lock said lock cylinder in place in said hole.

8. A lock and panel system as set forth in claim said 6 in which said housing body includes ridges on its surface parallel to its axis, said ridges serving to hold said housing body against rotation relative to said hole.

9. A lock and panel system as set forth in claim 8 in which said ridges are adjacent to said flange and the length of said ridges is less than the length of said housing body.

10. In a lock installed in a panel, said panel having parallel inner and outer panel surfaces, a thickness, and a transverse hole through said panel to receive said lock, that improvement including a lock housing having a flange at one end thereof, said housing having a cylindrical housing body with a length less than said panel thickness and a diameter approximately the same as that of said hole, said housing body, when mounted in said hole, having an axis transverse to said panel surfaces, a lock cylinder having a common axis with said housing body and mounted within said housing body, said lock cylinder having a length less than said panel thickness, said lock cylinder having a threaded member extending therefrom beyond said inner surface, said threaded member having a diameter less than that of said lock cylinder, a securing member fitting about said threaded member, and means for securing said securing member in place on said threaded member in a position in which said securing member will press against said inner surface of said panel in all positions of said securing member, whereby said securing member, by pressing against said inner surface, holds said lock cylinder in place in said hole.

11. In a lock as set forth in claim 10, that improvement in which said securing member includes a cam lever, and said cam lever presses against said inner surface.

* * * * *